US005584165A

United States Patent [19]

Wright

[11] Patent Number: 5,584,165

[45] Date of Patent: Dec. 17, 1996

[54] METHOD OF FILLING AND INSERT FOR A CONTAINER

[75] Inventor: Timothy Wright, Solihull, United Kingdom

[73] Assignees: Whitbread PLC, London, United Kingdom; Heineken Technical Services B.V., Amsterdam, Netherlands

[21] Appl. No.: 532,696

[22] PCT Filed: Jun. 17, 1994

[86] PCT No.: PCT/GB94/01312

§ 371 Date: Sep. 25, 1995

§ 102(e) Date: Sep. 25, 1995

[87] PCT Pub. No.: WO95/00415

PCT Pub. Date: Jan. 5, 1995

[30] Foreign Application Priority Data

Jun. 18, 1993 [GB] United Kingdom ..... 9312677

[51] Int. Cl.[6] ..... B05B 31/02

[52] U.S. Cl. ..... 53/432; 426/115; 426/124; 426/132

[58] Field of Search ..... 53/432, 234; 426/112, 426/115, 124, 132; 206/217, 219, 221

[56] References Cited

U.S. PATENT DOCUMENTS

| | | | |
|---|---|---|---|
| 4,627,986 | 12/1986 | Bardsley et al. | 206/217 |
| 4,832,968 | 5/1989 | Forage et al. | 426/115 |
| 5,290,574 | 3/1994 | Jameson et al. | 426/112 |
| 5,466,473 | 11/1995 | Forage et al. | 426/115 |
| 5,474,788 | 12/1995 | Lynch | 426/115 |

FOREIGN PATENT DOCUMENTS

| | | |
|---|---|---|
| 0349053 | 1/1990 | European Pat. Off. . |
| 0577284 | 1/1994 | European Pat. Off. . |
| 0594221 | 4/1994 | European Pat. Off. . |
| 2267882 | 12/1993 | United Kingdom . |
| 9107326 | 5/1991 | WIPO . |
| 9309055 | 5/1993 | WIPO . |
| 9310021 | 5/1993 | WIPO . |

*Primary Examiner*—John Sipos
*Assistant Examiner*—Gene L. Kim
*Attorney, Agent, or Firm*—Sughrue, Mion, Zinn, Macpeak & Seas

[57] ABSTRACT

An insert (10, 12) for use in providing a creamy head on a carbonated beverage dispensed from a beverage container (50) comprises a restricted orifice (20) for providing communication between its inside and outside, and a pressurized gas contained inside. The restricted orifice (20) is separated from the pressurized gas by a closure (22) which is arranged to be permanently and irreversibly opened on being subjected to a temperature above a predetermined threshold, or on being subjected to a pressure difference in which the pressure outside the insert (10, 12) exceeds that within. This enables the insert to be pre-pressurized and completely closed and stable during insertion into the container (50) and during filling. Then the closure (22) is permanently and irreversibly opened during a subsequent pasteurization step to ensure that all of the gas is vented from the insert (10, 12) on opening the container (50).

2 Claims, 4 Drawing Sheets

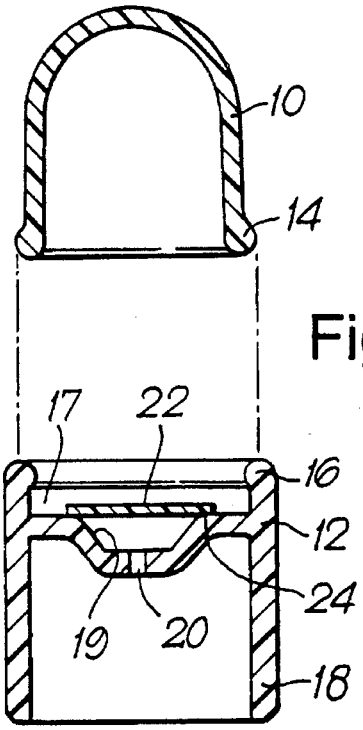
Fig.1.
Fig.2.
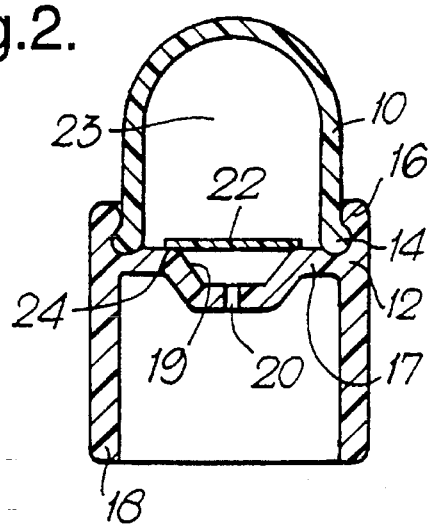
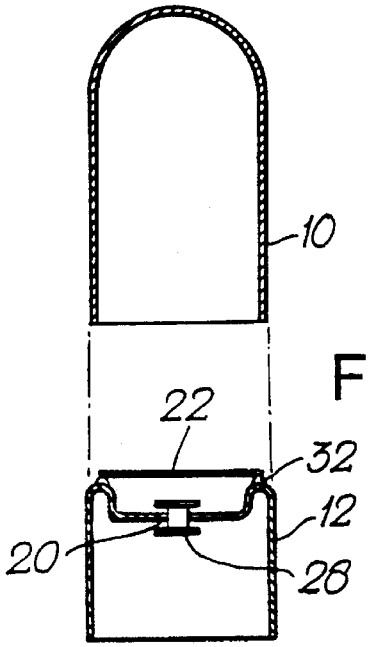
Fig.3.
Fig.4.
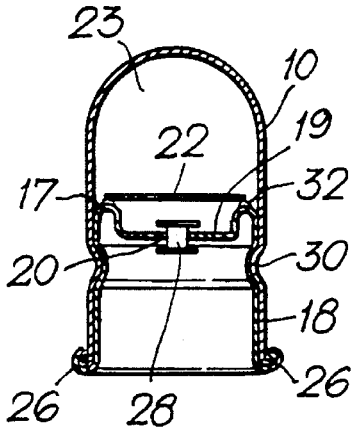

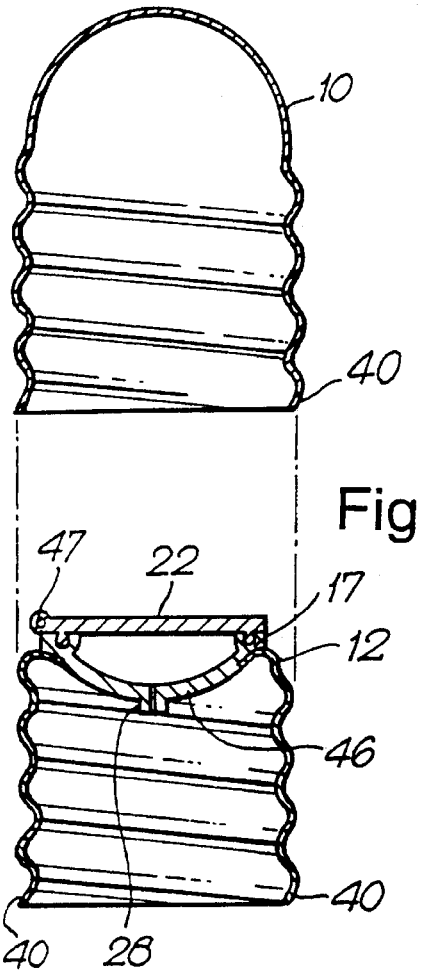
Fig.5.
Fig.6.
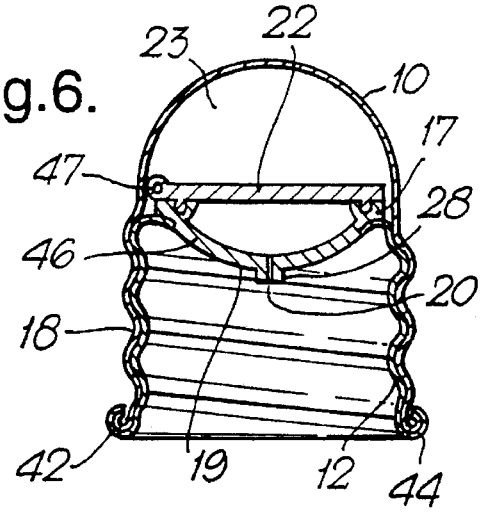
Fig.7.
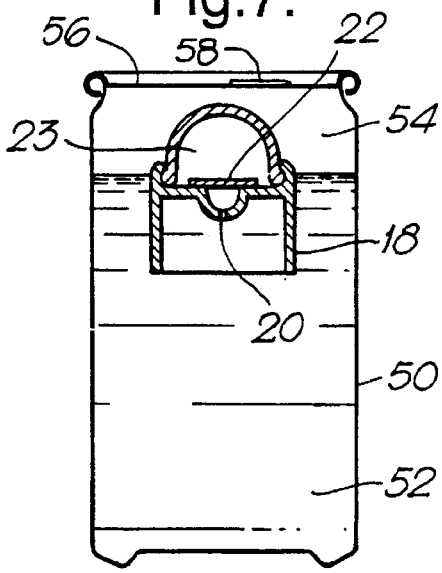
Fig.8.
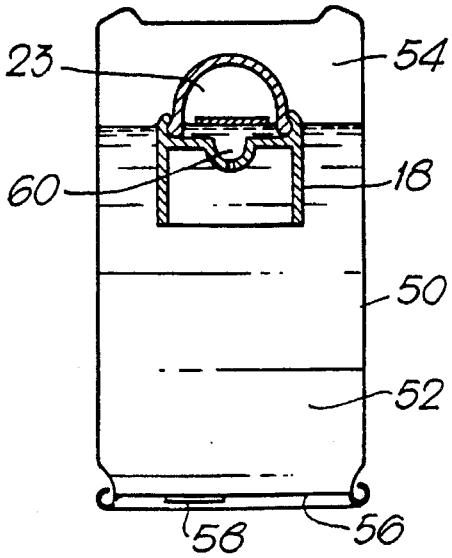

METHOD OF FILLING AND INSERT FOR A CONTAINER

FIELD OF INVENTION

When dispensing carbonated beverages, particularly beers and especially draught stout, it is desirable to obtain a close-knit creamy head. This contributes to a creamy taste and adds considerably to the customer appeal. Traditionally such heads are only obtained when dispensing such beverages from draught. Another factor that considerably enhances their appeal is the way in which, when dispensing beverages, especially beers, from draught, small bubbles are intimately mixed with the body of the beverage as it is dispensed and then, after dispensing is completed they gradually separate out to form this close-knit creamy head.

BACKGROUND ART

GB-A-1,266,351 discloses a number of beverage containers where a secondary chamber is provided which contains gas charged to a pressure substantially above atmospheric pressure. In one example, the secondary chamber is permanently in communication with the container via a restricted orifice and is charged with gas under pressure at the time of filling of the container. In another example, the secondary chamber is filled with gas and the restricted orifice sealed with gelatine or other non-toxic substance which is intended to retain the gas under pressure within the secondary chamber prior to and during filling but which dissolves after contact with the beverage for a period of time to open the restricted orifice. In a further example, the restricted orifice is provided in a flexible wall of the chamber which is exposed to the pressure in the main body of the container, the arrangement being such that pressure in the main body of the container holds the region of the wall around the restricted orifice sealed against a grommet until the container is opened, whereupon the resultant release of pressure results in the seal being broken and permits the gas under pressure from the secondary chamber to jet into the beverage through the restricted orifice. For a variety of reasons, none of these designs have met with commercial success.

GB-A-2,183,592 discloses a beverage container wherein, instead of gas being jetted from the secondary chamber by way of a restricted orifice, carbonated beverage or carbonated beverage followed by gas is jetted through a restricted orifice in order to induce fine bubble formation in the main body of the beverage. This system has been commercialised, but it is widely accepted that jetting gas only rather than carbonated beverage or carbonated beverage followed by gas, provides better bubble nucleation and hence better head formation. GB-A-2,183,592 discloses a number of constructions wherein the secondary chamber may be constructed as an integral part of the beverage container or it may be formed as a discrete insert which is deposited or pushed into a conventional form of can, bottle or carton. Preference is expressed in GB-A-2,183,592 for an insert which is retained in position, for example at the bottom of the container, by an appropriate adhesive or by mechanical means. However, there is described the possibility of using a discrete insert which may be suspended or float in the beverage in the container provided that the restricted orifice is maintained below the surface of the beverage in the container on opening the container. The possibility of loading or weighting the insert to orientate the position of the restricted orifice is described.

EP-A-0,520,646 describes another proposal in which a beverage container has an insert with a restricted orifice which is arranged to jet gas only into the beverage. This insert is charged with gas by inverting the container promptly after it has been filled with beverage and the headspace above the beverage in the container pressurised so that the restricted orifice is exposed to pressure within the headspace above the beverage in the inverted container. Failure to ensure that the container remains inverted during the pressurization stages, including pasteurisation, results in the insert being filled with a significant amount of beverage, thereby losing all the benefits to be achieved by ejection of gas only under pressure from the insert when the container is opened. In practice, this can occur when there is an unforeseen production line stoppage which results in containers being stopped before inversion. Additionally, during pasteurisation, containers frequently fall over and are pasteurised on their side, in which orientation it is possible for substantial amounts of the beverage to enter the insert, especially since a high pressure exists in the container as a result of heating of the sealed container to the pasteurisation temperature.

With both the systems described in GB-A-2,183,592 and EP-A-0,520,646 since the insert is open via its restricted orifice before it is placed into the beverage container it is full of air. It is essential however to remove all of the air from the insert and container combination before filling it with beverage. The presence of oxygen inside the container leads to the beverage being oxidised with the resulting impairment of flavour and risk of microbial growth leading to, for example, acetification of the beverage when it contains alcohol. This removal of air is difficult to achieve in practice. Typically the container and insert combination is subjected to a purging regime using an inert gas such as nitrogen, carbon dioxide or a mixture of these and repeated pressurisation and depressurisation stages. This requires the use of an especially modified filling machine and substantially increases the filling cycle time.

This difficulty has been overcome in a system disclosed in WO-A-91/07326 in which an insert which jets gas only into the beverage in the main body of the container is pre-pressurized with gas and includes a closure means. The closure means remains sealed before filling and during the container filling operation but when the beverage container is subsequently opened, de-pressurisation of the beverage container results in the insert releasing a surge of gas from a restricted orifice into the beverage to "seed" the required nucleation of dissolved gas bubbles to produce the required rich creamy foam. This system has met with considerable commercial success. Since the insert is sealed at all material times before the container is finally opened by the consumer the container and insert combination can be filled as easily, simply and quickly as conventional container. A disadvantage of this type of system is that the insert may contain a residual pressure after the container has been emptied. There is a risk a consumer will cut open the empty container and thus be able to interfere with a pressurised insert.

WO-91/07326 discloses a very large number of ways in which the pressurized gas insert can be formed and mounted within the beverage container. In most examples, the insert is mounted so that, in use, it is located at a fixed position. However, an example is also described where the insert floats in the liquid in the container and has a weight attached to its base for orientating the insert so that the restricted orifice is submerged in the beverage.

DISCLOSURE OF INVENTION

According to this invention, a method of packaging a beverage container comprises the steps of:

(a) placing an insert containing a pressurised gas in the container;

(b) filling the container with beverage;

(c) sealing the container with the beverage and insert in it, characterised in that the insert has a restricted orifice for providing communication between the inside of the insert and the container and also having a closure for preventing release of the pressurised gas from the insert, the closure being arranged to be permanently and irreversibly opened on being subjected to a temperature above a pre-determined threshold, or on being subjected to a pressure difference in which the pressure in the container exceeds that within the insert, and in that;

(d) after sealing the container causing the pressure in the sealed container to exceed the pressure within the insert to cause the closure permanently and irreversibly to Open so that, thereafter the inside of the insert is in communication with the beverage in the container via the restricted orifice.

Preferably, step (d) is carried out during a pasteurisation step on the beverage in the container. Typically the container and beverage are heated to a temperature of around 60° C. for about fifteen to twenty minutes. This results in a considerable increase in pressure inside the container.

An insert for use in the present invention comprising a restricted orifice for providing communication between the inside and outside of the insert, and a pressurised gas contained inside the insert, is characterised in that the restricted orifice is separated from the pressurised gas by a closure which is arranged to be permanently and irreversibly opened on being subjected to a pressure difference in which the pressure outside the insert exceeds that within.

The insert may be arranged to be held in a fixed position in the container and, in this case, is preferably held adjacent the base of the container. However, the insert preferably floats on the surface of the beverage in the container, and includes means for orientating it so that its restricted orifice is submerged in the beverage irrespective of the orientation of the container. Preferably the means for orientating the insert is symmetrically arranged relative to the restricted orifice. The insert may symmetrical about a vertical axis with the restricted orifice being located on this axis. The orientation means may have a positive or negative buoyancy relative to the beverage in which it is used.

The insert is conveniently made in two parts which are arranged to be sealingly secured together in a pressurized chamber containing the gas to be contained within the insert at the desired pressure. The two parts may be sealingly secured together by snap-fitting, screw-threading, welding, an adhesive or by folding and sealing inter-engaging flanges.

The gas in the insert is preferably an inert or non-oxidizing gas or gas mixture, preferably nitrogen and/or carbon dioxide.

The insert may be moulded from a synthetic resin material such as polypropylene or be formed of metal such as lacquered aluminium, lacquered tin plate, polymer-coated aluminium, polymer-coated tin plate or tin-free steel. When the insert is made of metal and the container is also made of metal they are both preferably made of the same metal to facilitate re-cycling.

The closure may be a member which is held against a sealing surface in the insert by the internal gas pressure, and it may be attached within the insert by any suitable means such as a weak heat seal, an interference fit, a heat sensitive adhesive, a temporary glue bond or a snap-fit engagement. In each case it is arranged to be detached when the external pressure exceeds the internal pressure or on application of heat. Alternatively, the closure may take the form of a weakened portion, membrane, tape or film which is located within the insert and which is supported so that it can withstand the internal gas pressure when the exterior pressure is less, but which is ruptured when the external pressure exceeds the internal pressure.

The effective volume of the inside of the insert is preferably about 2 to 7 ml, depending upon the size of the container and the type of beverage. The size of the restricted orifice is typically 0.8 mm, but may vary from 0.05 to 3 mm depending upon the foam characteristics required and the type of beverage.

The present invention has similar advantages to that described in WO-A-91/07326 as a result of it being closed upon insertion into the container so that the container can be filled and sealed at high speed using conventional machinery and yet, because the closure in the insert is of a type which, once opened, remains permanently open, avoids the possibility of pressure remaining in the insert after the container has been opened.

DESCRIPTION OF DRAWINGS

FIGS. 1 and 2 are diagrammatic sections through a first example of insert before and after gas pressurisation, respectively;

FIGS. 3 and 4 are similar views of a second example;

FIGS. 5 and 6 are similar views of a third example;

FIGS. 7, 8, 9 and 10 are a sequence of sectional views of a beverage container containing the first example of insert showing, respectively, the conditions immediately after sealing of the container, at maximum pressure during pasteurisation, immediately prior to opening of the container, and immediately after opening of the container;

Referring now to FIGS. 1 and 2, the insert illustrated therein is symmetrical about its vertical axis and comprises moulded plastics (e.g. polypropylene) upper and lower components 10 and 12 which can be snap fitted together. The upper component 10 is bowl shaped and includes an outwardly directed annular sealing lip 16 around its rim. The lip 14 snap engages with an inwardly directed lip 16 around the upper rim of lower component 12 which basically takes the form of a collar having a partition wall 17 adjacent its upper end so as to define a skirt 18 below the partition wall 17. The skirt 18 serves to orientate the insert in use. The partition wall 17 has a central depressed region 19 with a restricted orifice 20 through the centre thereof. The orifice 20 is thus arranged on the vertical axis of symmetry of the insert and discharges vertically downwardly when in its intended orientation. It will therefore be appreciated that the skirt 18 is symmetrically arranged relative to and around the orifice 20 and that it extends vertically downwardly below the orifice 20. Although not shown in the drawings, the skirt 18 is provided with a pair of diametrically opposed gas escape passages therethrough at its upper end, i.e. at a level above the restricted orifice 20.

Figure 9:
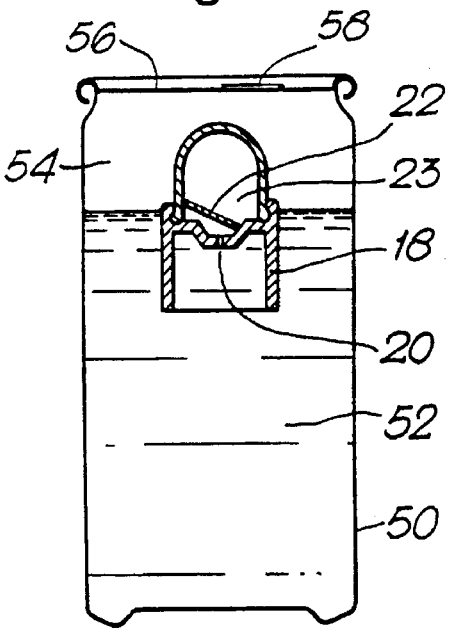
Figure 10:
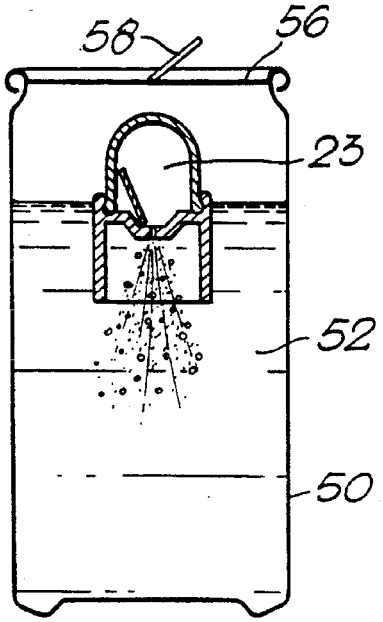

A closure member in the form of a plastics disc 22 is temporarily secured by means of a weak heat seal 24 over the central depression 19 so that the disc 22 is substantially sealed against the partition wall 17. In order to pressurize the insert, the upper and lower components 10 and 12 with the disc 22 in the position illustrated in FIG. 1 are introduced into a chamber (not shown) which is pressurized with gas at the required pressure, typically 55 psi gauge (380 KPa) and then snap-fitted together by means of the lips 14 and 16. Thus, there is defined a reservoir 23 containing the pressurized gas. The internal gas pressure in the reservoir 23 assists in maintaining the seal between the lips 14 and 16 and also in maintaining the seal between the disc 22 and the partition wall 17 after the upper and lower components 10 and 12 have been snap-fitted together as illustrated in FIG. 2. In this condition, the insert can be removed from the pressurized chamber and is ready to be introduced into a beverage container.

Referring now to FIGS. 3 and 4, the insert is similar to that of FIGS. 1 and 2 and similar parts are accorded the same reference numerals. However, in this embodiment, upper and lower components 10 and 12 are each formed of a coated metal sheet and are secured together in sealing relationship by forming a seal by double folding as illustrated at 26 in FIG. 4. In this second example, restricted orifice 20 is defined within a small plastics push-fit plug 28 engaged in an aperture formed in the base of the central depression 19 of partition wall 17. Such plug 28 serves to protect the cut edge of the coated metal against contact with the beverage in use, thereby to prevent metal pick-up by the beverage. An annular indent 30 is formed around the engaged components 10 and 12 adjacent the partition wall 17 in order to strengthen the side wall of the insert to prevent internal pressure from pulling apart the seam 26. In this embodiment, the disc 22 is formed from coated metal sheet which has edges curled downwardly and embedded into a ring of sealant material 32 which is designed to have only weak adhesion to the surface of the lower component 12 but permanent adhesion to the exposed cut metal edge of the disc 22. This sealant can be composed of a variety of food approved materials, such as can end sealant compounds and hot melt adhesives e.g. a reactive hot melt polyurethane adhesive. As in the first example, the insert of FIGS. 3 and 4 is assembled in the pressurized chamber in which double sealing at 26 and indenting at 30 take place.

In the third example illustrated in FIGS. 5 and 6, upper and lower components 10 and 12 are formed of coated metal sheet and are designed so as to be screw-threaded together over the region of the orientation skirt 18, with the pressure seal therebetween enhanced by application of a suitable adhesive or lining compound to the mutually-engaging screw threaded surface of the upper and lower components 10 and 12. The exposed cut edges 40 of the coated metal sheets from which the upper and lower components 10 and 12 are formed can be protected by an application of a lining compound 42 (see the left hand side of FIG. 6) or by a curling-over operation to produce a curl edge 44 (see the right hand side of FIG. 6), or a combination of both if desired. In this example, the restricted orifice 20 is provided in a plug 28 which is snap-fitted into a central aperture of the base 12. The plug 28 is bowl shaped and forms the majority of the partition wall 17. The disc 22 is also integrally moulded with the plug 28 and is joined to it by an integral, thin strap or hinge 47 so that the disc 22 can be snap-fitted into sealing engagement with the rim of the plug 28.

FIG. 7 shows the first example of insert in a beverage can 50 which has just been filled with beverage 52 so as to leave a headspace 54 and which has been sealed using seaming operation to fit a can top 56 having an easy opening tab 58. The insert may be introduced into the open can 50 before filling with the beverage 52 or it can be introduced after filling, or even during filling. The seaming of the can top 56 to the can 50 takes place in a known manner so that the can 50 is completely sealed with beverage 52 therein carbonated with carbon dioxide and a proportion of nitrogen. Additionally the headspace 54 may be charged with nitrogen in a known manner.

Filling, closing and pressurizing of the can 50 takes place so that the balance of dissolved gases used are adjusted so that the pressure within the can 50, when at equilibrium at normal domestic refrigeration temperature (typically 5° to 10° C.), is below the initial gas pressure within the insert. The exact pressure levels vary depending upon the beverage being packed. In practice, it is desired to maintain the pressure difference in this respect within the range of about 35 to 180 KPa. With modern filling valve technology, this is readily achievable. In the case where the beverage is ale or stout having a carbonation level in the range of 1.0 to 1.1 vol/vol, it is preferred for the gas pressure within the insert to be about 380 KPa and for the final equilibrium pressure within the can to be in the range of about 200 to 345 KPa. In practice, it has been found for example that for 440 ml of beverage in a 500 ml can, the final equilibrium pressure for a 1.0 to 1.1 vol/vol carbonated beverage is the same as the pressure measured on exit from the seaming operation. This enables convenient control of can pressure levels using automatic can pressure measurement means which are readily available.

Once the can 50 has been sealed, it is subjected to pasteurisation in a known manner in order to ensure that the contents of the can are micro-biologically stable. This process requires the can contents to reach a temperature in the region of 60° C. for about fifteen minutes. At maximum pasteurisation pressure, the can is inverted (see FIG. 8). During the heating stage of the pasteurisation process, dissolved gases in the can 50 come out of solution and result in a rapid rise in pressure within the can 50 where peak pressures reach levels of about 480 to 650 KPa depending upon the initial can pressure after closing. In contrast, the gas pressure inside the reservoir 23 of the insert does not rise significantly as the pressure only increases as a result of gas expansion alone. Thus, the pressure inside the can 50 exceeds the pressure inside the reservoir 23. Once the pressure in the main body of the can exceeds the internal pressure in the insert by a predetermined amount, typically about 35 KPa, the disc 22 is blown inwardly away from its sealing contact with the sealing surface of the partition wall 17. This process is irreversible so that, at all times thereafter, the inside of the insert communicates with the outside, i.e., with the interior of the can 50, via the restricted orifice 20. A portion 60 of the beverage enters the reservoir 23 throughout the pressure build-up stage of the pasteurisation process to equalise pressure between the insert and the can 50. Once the heating stage of the pasteurisation cycle is completed and the container is cooled, the pressure falls until, at about 30° C., the can 50 leaves the pasteuriser. At this stage, the pressure in the can 50 is in the region of 345 to 450 KPa. The pressure equalisation between the insert and the can takes place with the beverage being ejected from the insert back into the can 50 through the restricted orifice 20 during the pressure drop part of the cycle. The insert floats on the beverage in the can 50 with the restricted orifice 20 always lowermost as a result of the orientation skirt 18.

On exit from the pasteuriser, the can 50 is packed into secondary packaging and stored ready for distribution. After a period, typically less than two weeks, the can reaches full equilibrium conditions and the pressures within the can 50 and the reservoir 23 are in the region of 240 to 380 KPa depending upon ambient temperature. Throughout the storage period, as pressure is reduced inside the can due to gases becoming dissolved into the beverage, any beverage remaining inside the insert continues to be forced out of the insert until the pressure falls below the initial charging pressure of the insert. At this stage, further pressure drop results in ejection of gas from the insert into the main container, again to equalise pressure. At this stage, the condition of the can is typically as shown in FIG. 9 where the disc 22 is no longer sealed against the partition wall 7 and there is no beverage within the insert.

When the can 50 is opened, preferably after refrigeration, by opening tab 60, the pressure in the can 50 is suddenly released, and this results in a jetting of tiny bubbles of pressurized gas from the reservoir 23 through the restricted orifice 20 into the beverage 52. The produces a creamy rich foam to the beverage when it is poured into a glass or other drinking receptacle.

Figure 11:
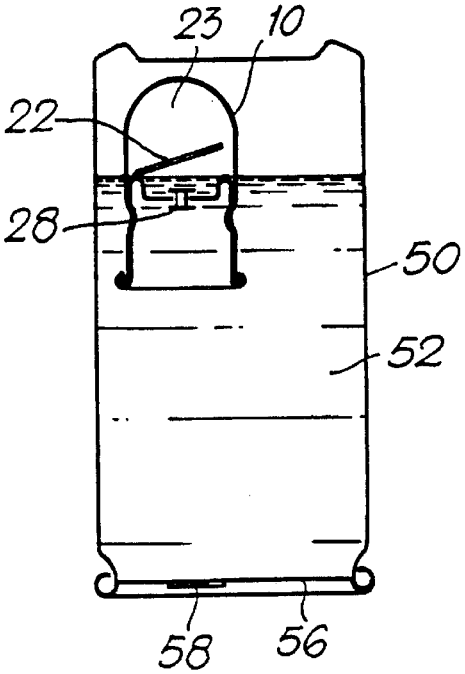
FIGS. 11 and 12 show the situation at maximum pressure during pasteurisation of the second and third examples of inserts, respectively; and, FIG. 13 is a diagrammatic section through a fourth example immediately after filling but before pasteurisation.
Figure 12:
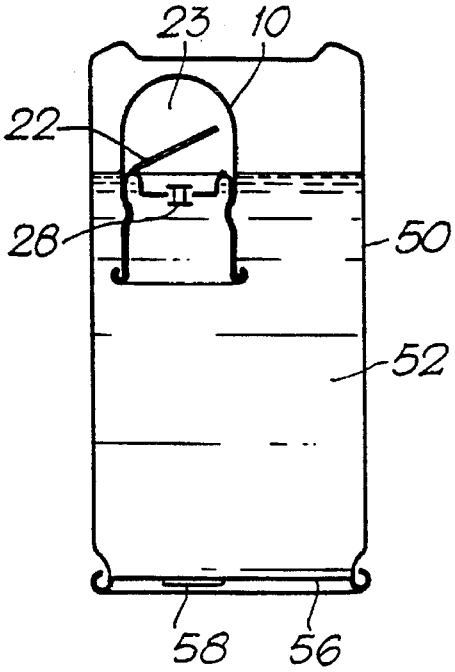

The second and third examples of inserts operate in a similar way to that described above and the condition of cans fitted with such inserts at maximum pressure during the pasteurisation stage are illustrated in FIGS. 11 and 12.

Figure 13:
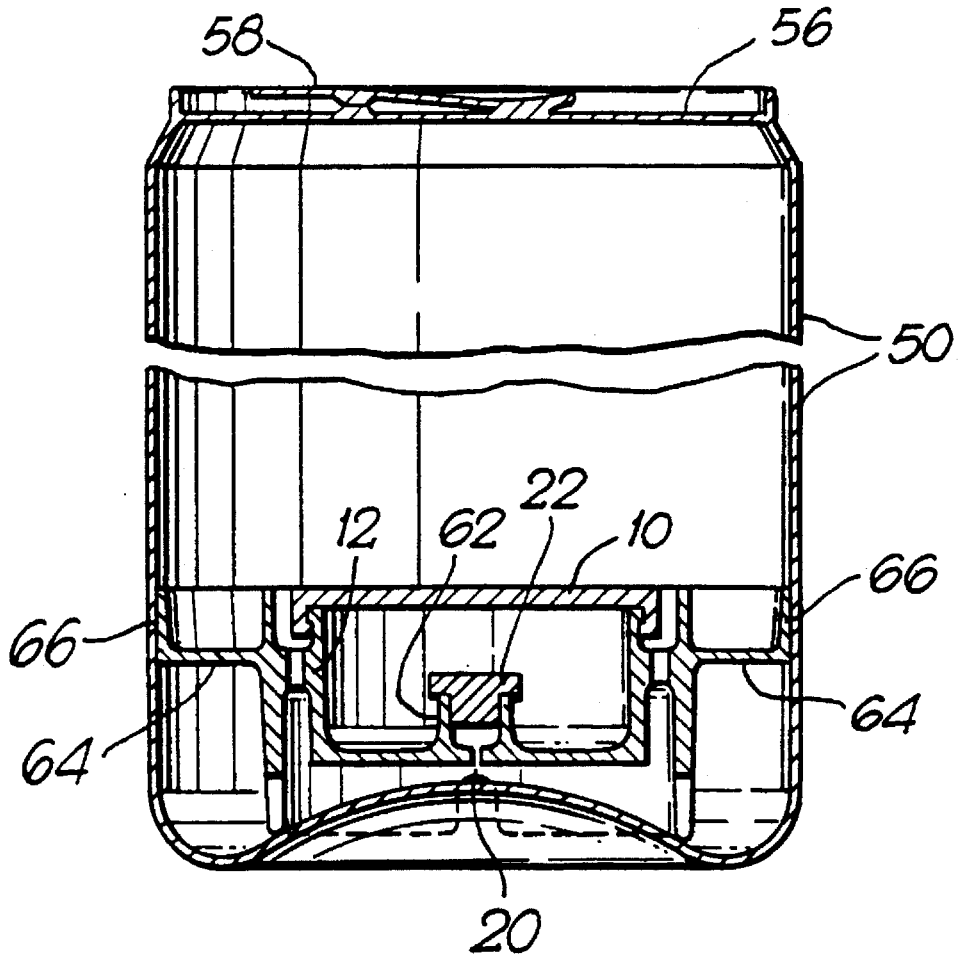

The fourth example shown in FIG. 13 is again essentially in two parts 10 and 12 which snap-fit together with a restricted orifice 20 in the base of the part 12. A tubular portion 62 surrounds the orifice 20 on the inside of the insert and the closure member 22 has the form of a plug which is a push-fit in the tubular portion 62. Lower portion 12 includes a surrounding flange 64 with an upturned rim 66 which engages the side wall of a can 50 to hold the insert in position adjacent its base. After the plug 22 is fitted in the tubular portion 62, the two parts 10 and 12 are again assembled in a pressurised chamber. The insert is then placed in position in a can, the can filled with beverage and sealed by seaming on a lid 56. The can 50 is then inverted in a pasteuriser and heated. When the can is inverted the orifice 20 lies in the headspace above the beverage. As the pressure in the can 50 builds up during pasteurisation the plug 22 is blown out of the tubular portion 62 and into the inside of the insert. With this example only gas enters the insert during pasteurisation. As the can 50 is cooling down at the end of the pasteurisation step the can 50 is erected. On subsequently opening the can 50 gas is jetted out of the restricted orifice 20 and generates small bubbles which gradually rise through the beverage triggering the release of further small bubbles as they rise.

What is claimed is:

1. A method of packaging a beverage container (50) comprises the steps of:

(a) placing an insert (10, 12) containing a pressurised gas in the container (50);

(b) filling the container (50) with beverage (52);

(c) sealing the container (50) with the beverage and insert (10, 12) in it, characterised in that, the insert (10, 12) has a restricted orifice (20) for providing communication between the inside of the insert (10, 12) and the container (50) and also having a closure (22) for preventing release of the pressurised gas from the insert (10, 12), the closure (22) being arranged to be permanently and irreversibly opened on being subjected to a temperature above a predetermined threshold, or on being subjected to a pressure difference in which the pressure in the container (50) exceeds that within the insert (10, 12), and in that, (d) after sealing the container (50) causing the pressure in the sealed container to exceed the pressure within the insert (10, 12) to cause the closure (22) permanently and irreversibly to open while said container is sealed so that, thereafter the inside of the insert (10, 12) is in communication with the beverage (52) in the container (50) via the restricted orifice (20).

2. A method of packaging according to claim 1, in which step (d) is carried out during a pasteurisation step on the beverage (52) in the container (50).

* * * * *